United States Patent [19]

Parker

[11] Patent Number: 5,076,242

[45] Date of Patent: Dec. 31, 1991

[54] INTEGRAL FUEL LINE

[75] Inventor: Eric G. Parker, Elgin, Ill.

[73] Assignee: Illinois Tool Works Inc., Glenview, Ill.

[21] Appl. No.: 554,741

[22] Filed: Jul. 18, 1990

[51] Int. Cl.[5] ..... F02M 37/04; F02M 55/02

[52] U.S. Cl. ..... 123/514; 123/516; 123/468; 137/594; 138/114

[58] Field of Search ..... 123/514, 516, 518, 456, 123/468, 469, 470, 467; 285/13, 14; 138/113, 114, 115, 148; 137/594

[56] References Cited

U.S. PATENT DOCUMENTS

| | | | |
|---|---|---|---|
| 2,348,478 | 5/1944 | Jones | 137/594 |
| 3,171,448 | 3/1965 | Fromm | 137/594 |
| 3,845,748 | 11/1974 | Eisenberg | 123/468 |
| 4,009,739 | 3/1977 | Weatherford | 138/114 |
| 4,014,369 | 3/1977 | Korres | 138/148 |
| 4,451,966 | 6/1984 | Lee | 138/114 |
| 4,467,610 | 8/1984 | Pearson | 138/114 |
| 4,485,790 | 12/1984 | Nishimura | 123/468 |
| 4,491,297 | 1/1985 | Maier | 138/113 |
| 4,570,686 | 2/1986 | Devine | 138/114 |
| 4,601,275 | 7/1986 | Weinand | 123/516 |
| 4,722,708 | 2/1988 | Baltz | 123/468 |
| 4,748,104 | 11/1988 | Dimond | 123/516 |
| 4,763,683 | 8/1988 | Carmack | 137/594 |
| 4,798,187 | 1/1989 | Hudson | 123/469 |
| 4,930,544 | 6/1990 | Itu | 138/115 |
| 4,982,902 | 1/1991 | Knapp | 138/113 |

FOREIGN PATENT DOCUMENTS

| | | | |
|---|---|---|---|
| 2210756 | 9/1972 | Fed. Rep. of Germany | 138/114 |
| 3739937 | 6/1989 | Fed. Rep. of Germany | 123/468 |
| 2180182 | 3/1987 | United Kingdom | 138/114 |

*Primary Examiner*—Carl Stuart Miller

[57] ABSTRACT

An integral fuel line for use in a fuel injection type of fuel distribution system for motor vehicles includes an innermost tube defining a high pressure line, an intermediate tube defining a low pressure line, and an outer tube defining a vapor recovery line. The innermost tube has a first passage for delivering fuel from a storage tank to an engine cylinder of a motor vehicle. The intermediate tube is spaced from and surrounds the innermost tube to form a second passage therebetween for returning the unused portion of fuel back to the storage tank. The outer tube is spaced from and surrounds the inatermediate tube to form a third passage therebetween for returning vaporized and evaporated fuel back to the storage tank.

20 Claims, 1 Drawing Sheet

INTEGRAL FUEL LINE

BACKGROUND OF THE INVENTION

1. Field of the Invention

This invention relates generally to fuel distribution systems for motor vehicles and more particularly, it relates to an improved integral fuel line for use in a fuel injection type of fuel distribution system for motor vehicles.

As is generally well known, in a fuel distribution system of the fuel injection type for motor vehicles there are required the use of three separate "fuel" lines. The first one of the "fuel" lines is sometimes referred to as a high pressure line which is used for delivering gasoline from a fuel storage tank (located at the rear of the motor vehicle) via a pump and a fuel rail to multiport injectors or a throttle body (located at the front of the motor vehicle) for subsequent distribution to various cylinders of the vehicle's engine. The second one of the "fuel" lines is sometimes referred to as a low pressure or return line which is located adjacent the exit end of the fuel rail or throttle body for returning excess or unused portion of the gasoline back to the fuel tank. The third one of the "fuel" lines, as is required by environmental protection laws, is generally referred to as a vapor recovery line which is used to collect vaporized and evaporated gasoline from the "canister" area and other points adjacent the vehicle's engine and to return the same back to the fuel storage tank.

Heretofore, these three "fuel" lines have been formed by separate individual pipes or tubes of similar diameter which are joined together and routed in parallel between the front and rear of the motor vehicle. Further, such "fuel" lines are typically made of a metallic material. Such conventional "fuel" line arrangements and construction have the associated problems of corrosion due to the water formed in the "fuel" lines, diffusion of hydrocarbons through the wall thickness of the "fuel" lines into the atmosphere causing pollution, build-up of electrostatic charge on the outer surfaces of the "fuel" lines due to the flow of fuel therein against the inner walls, and occupying of a relatively large amount of space.

2. Description of the Prior Art

A prior art search directed to the subject matter of this application in the U.S. Patent and Trademark Office revealed the following U.S. Letters Patent:

| | |
|---|---|
| 2,325,464 | 4,343,844 |
| 2,475,468 | 4,367,769 |
| 2,519,939 | 4,467,610 |
| 3,323,585 | 4,491,297 |
| 3,765,728 | 4,570,686 |
| 4,014,369 | |

In U.S. Pat. No. 2,325,464 to Clyde E. Bannister issued on July 27, 1943, there is disclosed a multipassage hose which includes an inner tube hose, an intermediate hose tube spaced from and surrounding the inner tube hose, and an outer hose tube spaced from and surrounding the intermediate hose tube. In U.S. Pat. No. 3,323,585 to Robert B. Cannon issued on June 6, 1967, there is disclosed a header structure for heat transfer apparatus which comprises a plurality of concentrically mounted and extended tubular members. U.S. Pat. No. 3,765,728 to Marco Peruglia issued on Oct. 16, 1973, discloses a piping for vehicular braking systems with brake fluid recirculation wherein the flexible pipe consists of two coaxial pipes, the inner of which is used to deliver brake fluid to a brake actuator cylinder and the outer of which formed a return flow duct from the cylinder.

In U.S. Pat. No. 4,014,369 to Adolph Kobres, Jr. issued on Oct. 29, 1977, there is shown a triple pipe low temperature pipeline arrangement wherein a low temperature liquid or hot gas is transferred through an inner pipe with the vapor or condensate return respectively being provided by an annulus between the inner pipe and a middle pipe. U.S. Pat. No. 4,467,610 to Carl E. Pearson et al. issued on Aug. 28, 1984 discloses a gas turbine fuel system wherein a manifold is formed with a double-walled construction to withstand high temperatures or fires around the combustor section and provide a secondary flow path for draining any fuel leakage from the manifold. The two walls of the manifold include an inner wall that encloses the primary fuel flow path through the fuel system. A concentric outer wall encloses the inner wall and protects the primary fuel flow path.

In U.S. Pat. No. 4,491,297 to Peter Maier et al. issued on Jan. 1, 1985, there is disclosed a three-way coupling which is joined up with a flexible pipe made up of three pipes nested in each other. U.S. Pat. No. 4,570,686 to George T. Devine issued on Feb. 18, 1986 discloses an apparatus for preventing blockage of vapor recovery hose by liquid fuel wherein the center pipe directs fuel to the nozzle with an annulus between the center pipe and the outer pipe for directing vapor flow from the nozzle. The remaining patents uncovered from the search but not specifically discussed merely show the state of the art relating to tubular assemblies and coupling members therefor and are thus considered to be only of general interest.

However, none of the prior art uncovered in the search disclosed an integral fuel line for use in a fuel injection type of fuel distribution for motor vehicles like that of the present invention. The integral fuel line includes an innermost tube defining a high pressure line, an intermediate tube defining a low pressure line and being disposed around the innermost tube, and an outer tube defining a vapor recovery line being disposed around the intermediate tube.

SUMMARY OF THE INVENTION

Accordingly, it is a general object of the present invention to provide an improved integral fuel line for use in a fuel injection type of fuel distribution system for motor vehicles which is relatively simple and economical to manufacture and assembly, but yet overcomes the disadvantages of the prior art fuel lines.

It is an object of the present invention to provide an improved integral fuel line which includes a plurality of tubes arranged in a concentric or tangential relationship so as to occupy a relatively smaller space than has been traditionally encountered.

It is another object of the present invention to provide an improved integral fuel line which eliminates the use of three separate individual fuel lines, thereby reducing its size.

It is still another object of the present invention to provide an improved integral fuel line which is formed of a plurality of concentric or tangential tubes, each tube being made of a plastic material so as to eliminate and/or reduce the problems of corrosion and diffusion.

It is yet still another object of the present invention to provide an improved integral fuel line for use in a fuel injection type of fuel distribution system for motor vehicles which includes an innermost tube, an intermediate tube being disposed around the innermost tube, and an outer tube being disposed around the intermediate tube.

In accordance with these aims and objectives, the present invention is concerned with the provision of an improved integral fuel line for use in a fuel injection type of fuel distribution system for motor vehicles which includes an innermost tube, an intermediate tube, and an outer tube. The innermost tube defines a high pressure line and has a first passage for delivering fuel from a storage tank to an engine cylinder of the motor vehicle. The intermediate tube defines a low pressure line and is spaced radially from the innermost tube in coaxial relationship to form a second passage therebetween for returning the unused portion of fuel back to the storage tank. The outer tube defines a vapor recovery line and is spaced radially from the intermediate tube in coaxial relationship to form a third passage therebetween for returning vaporized and evaporated fuel back to the storage tank.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENTS

Figure 1:
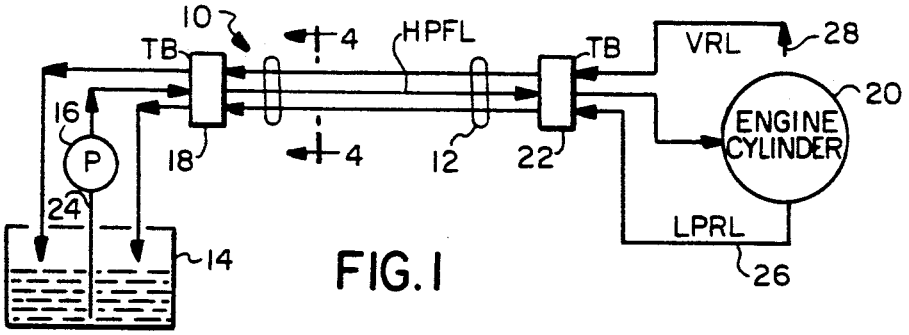
FIG. 1 is a diagrammatical representation of a fuel distribution system of a motor vehicle in which the integral fuel line of the present invention is utilized.

Referring now in detail to the drawings, there is shown in FIG. 1 a diagrammatical representation of a fuel distribution system 10 of the fuel injection type for a motor vehicle in which an integral fuel line 12 of the present invention is utilized. The fuel distribution 10 includes a fuel storage tank 14 from which a volumetric pump 16 draws fuel (gasoline) and delivers the gasoline via a first terminal block 18 or coupling member connected to one end of the integral fuel line 12 at the rear of the motor vehicle to individual engine's cylinders 20 at the front of the motor vehicle via a second terminal block 22 connected to the other end of the integral fuel line 12. For the sake of clarity, only one of the engine's cylinders 20 has been depicted.

As previously explained, in the fuel distribution system of the fuel injection type there is required a high pressure line 24 for delivering the gasoline from the fuel storage tank 14 to the various cylinders 20 of the vehicle's engine, a low pressure or return line 26 for returning the excess or unused portion of the gasoline back to the storage tank 14, and a vapor recovery line 28 for collecting vaporized and evaporated gasoline and also delivering the same back to the storage tank 14. The need of providing three such separate individual "fuel" lines running between the back and front of the motor vehicle involves certain disadvantages as previously discussed. These disadvantages are avoided by utilizing the integral fuel line 12 constructed according to the principles of the present invention for routing between the rear and front of the motor vehicle.

Figure 2:
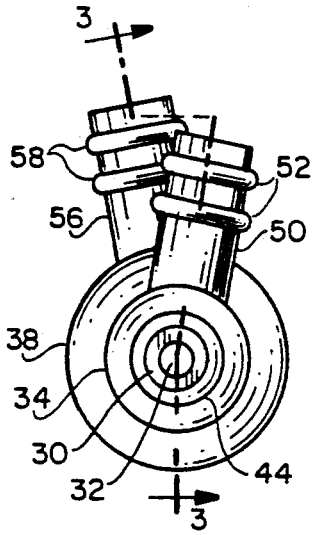
FIG. 2 is an end view of the integral fuel line with its associated terminal block.
Figure 4:
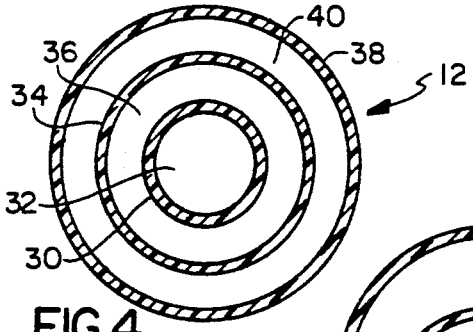
FIG. 4 is a cross-sectional view of the integral fuel line, taken along the lines 4—4 of FIG. 1.
Figure 3:
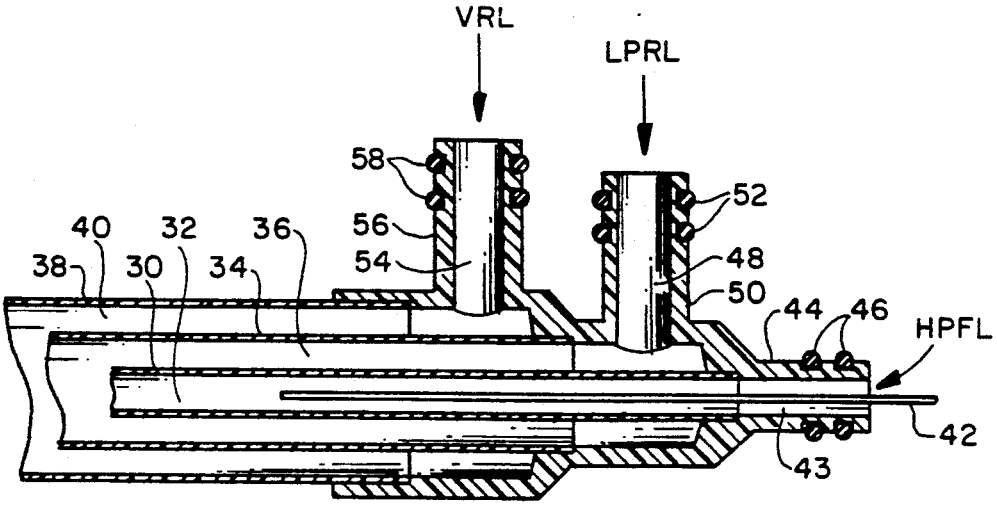
FIG. 3 is a cross-sectional view taken along the lines 3—3 of FIG. 2.

Since the integral fuel line 12 and its associated respective terminal blocks or coupling members 18, 22 at each end thereof is identical in its construction, it will be sufficient to show in detail and describe only one of the ends. As best seen from FIGS. 2 through 4, the integral fuel line 12 includes an innermost tube 30 defining the high pressure line and having a first passage or duct 32. The innermost tube 30 is preferably formed in its one embodiment of a flexible, thin-walled non-conductive plastic material. The first passage 32 is of a circular cross-section and serves to deliver the gasoline from the storage tank 14 under high pressure to the engine cylinder 20.

The integral fuel line 12 also includes an intermediate tube 34 which is spaced from and disposed substantially in a coaxial relationship with the innermost tube 30. The innermost tube 34 defines the low pressure or return line and is also preferably formed of a flexible, thin-walled non-conductive plastic material. A second passage or duct 36 is of an annular cross-section and is bounded between the internal surface of the intermediate tube 34 and the external surface of the innermost tube 30. The second passage serves to return the excess or unused portion of the gasoline back to the storage tank 14.

Further, the integral fuel line 12 includes an outer tube 38 which is spaced from and is disposed substantially in a coaxial relationship with the intermediate tube 34. The outer tube 38 defines the vapor recovery line and is likewise preferably formed of a flexible, thin-walled non-conductive plastic material. A third passage or duct 40 is also of an annular cross-section and is bounded between the internal surface of the outer tube 38 and the external surface of the intermediate tube 34. The third passage 40 functions to collect the vaporized and evaporated gasoline and to deliver the same back to the storage tank.

In practice, the length of each tube 30, 34 and 38 may be in the order of ten to twenty feet. The innermost tube 30 may have an inner diameter of 6 mm and an outer diameter of 8 mm with a 1 mm wall thickness. In order to provide the same equivalent area for fluid flow, the intermediate tube 34 will have an inner diameter of 10 mm and an outer diameter of 12 mm with a 1 mm wall thickness. Further, the outer tube will have an inner diameter of 13.4 mm and an outer diameter of 15.4 mm with a 1 mm wall thickness.

The advantages which the integral fuel line 12 provides over the conventional fuel line system is not only that there is eliminated the use of a plurality of separate individual "fuel" lines but also a corresponding reduction in the amount of space occupied. This is so because the integral fuel line is comprised of three concentrically mounted tubes wherein the high pressure line is made to be the innermost tube 30, the low pressure or return line is spaced from and surrounds the innermost tube, and the vapor recovery line is spaced from and surrounds the intermediate tube. Further, due to the fabrication of each tube from a non-conductive plastic material the problem of corrosion can be avoided.

With respect to the problem of diffusion to the outside atmosphere, this is only an issue with respect to the outer tube 38. However, since the amount of exposed surface area of the three concentric tubes in the present integral fuel line has been reduced approximately by 36% over the conventional fuel line system, there is a corresponding reduction in the amount of diffusion. In order to overcome the problem of electrostatic build-up, there is provided a central wire 42 (FIG. 3) which is disposed within the innermost tube 30 and having one end thereof connected to the vehicle chassis providing a ground path for the static discharge. Of course, in lieu of using the wire for grounding the electrostatic charge, the innermost tube 30 could be made of a conductive plastic material.

From a safety viewpoint, it can be seen that as part of this development that by placing the high pressure line to be the innermost tube, a defect in the high pressure line will not necessarily create or result in a catastrophic failure since it is surrounded coaxially by the intermediate tube 34 and then by the outer tube 38 respectively. In an alternate embodiment, the innermost tube 30 may be made of a carbon steel with a smaller wall thickness so as to further reduce the problem of diffusion. However, this would cause the innermost tube to be susceptible to corrosion. This can be overcome by using a corrosive-resistant metal such as stainless steel but would result in a higher cost.

Figure 6:
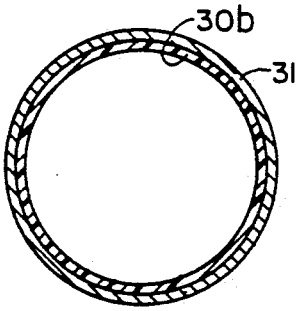
FIG. 6 is a cross-sectional view of an alternate embodiment of the innermost tube 30 of FIG. 4.

In addition, it should be apparent by those skilled in the art that any one of the tubes could be the one fabricated from the metallic material. In still another embodiment as shown in FIG. 6 of the drawings, the innermost tube **30*b* may be formed of a non-conductive plastic material on its inner diameter (6 mm) and is surrounded with an approximate 1 mm thickness layer 31** of metallic material so as to provide the innermost tube having an 8 mm outer diameter.

Figure 5:
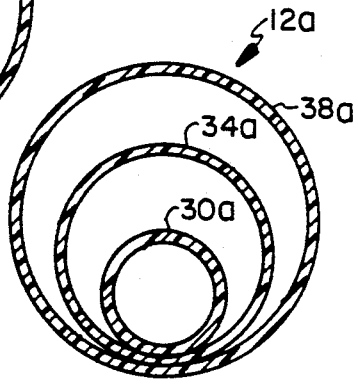
FIG. 5 is a cross-sectional view of an alternate embodiment of the integral fuel line of the present invention.

In an alternate embodiment of the integral fuel line **12*a* as shown in FIG. 5, the three tubes 30*a*, 34*a* and 38*a* are disposed tangentially in relationship to each other wherein the axis through the center of the outer tube 38*a* is parallel but spaced from the axes through the respective centers of the intermediate tube 34*a* and the innermost tube 30*a*. Except for this difference, the three tubes 30*a*, 34*a* and 38*a*** could be constructed with materials in the same manner as discussed above with respect to the three concentric tubes.

Referring now again to FIGS. 2 and 3, the details of the terminal block 22 is shown which is joined by an adhesive such as glue or other suitable means to the fuel line 12 adjacent the exit end of the fuel rail. The terminal block 22 is preferably formed of a flexible plastic material and includes a horizontally extending passage 43 whose axis is coaxial with the axis of the innermost tube 30 and is in fluid communication with the first passage 32. A high pressure coupling union 44 surrounds the passage 43 and is provided with double O-rings 46 on its outer surface to facilitate a rapid connection to a quick-connection member (not shown).

The terminal block 22 further includes a radial outwardly extending passage 48 whose axis is normal to the axis of the intermediate tube 34 and is in fluid communication with the second passage 36. A low pressure coupling union 50 surrounds the passage 48 and is provided with double O-rings 52 on its outer surface to facilitate a rapid connection to the quick-connection member. Further, the terminal block 22 includes a second radially outwardly extending passage 54 whose axis is normal to the axis of the outer tube 38 but may be angled with respect to the axis of the radial passage 48 and is in fluid communication with the outer duct 40. A vapor recovery coupling union 56 surrounds the passage 54 and is provided with double O-rings 58 on its outer surface to facilitate a rapid connection to the quick-connection member.

From the foregoing detailed description, it can thus be seen that the present invention provides an improved integral fuel line for use in a fuel injection type of fuel distribution system for motor vehicles which is formed of an innermost tube defining a high pressure line, an intermediate tube defining a low pressure line, and an outer tube defining a vapor pressure recovery line. The innermost tube, intermediate tube, and outer tube are arranged in a coaxial or tangential relationship with each other.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. An integral fuel line for use in a fuel injection type of fuel distribution system for motor vehicles, said fuel line comprising:

an innermost tube defining a high pressure line and having a first passage for delivering fuel from a storage tank to an engine cylinder of the motor vehicle;

an intermediate tube defining a low pressure line being spaced radially from said innermost tube in coaxial relationship to form a second passage therebetween for returning the unused portion of the fuel back to the storage tank; and an outer tube defining a vapor recovery line being spaced radially from said intermediate tube in coaxial relationship to form a third passage therebetween for returning vaporized and evaporated fuel back to the storage tank.

2. An integral fuel line as claimed in claim 1, further comprising terminal block means joined to the ends of said innermost, intermediate and outer tubes and having corresponding fluid passages in communication with the respective said first, second and third passages for facilitating a rapid connection to a quick-connection member.

3. An integral fuel line as claimed in claim 1, wherein said innermost, intermediate and outer tubes are made of a non-conductive plastic material, and wherein a wire is disposed within said innermost tube to ground static charge.

4. An integral fuel line as claimed in claim 1, wherein said innermost, intermediate and outer tubes are made of a conductive plastic material.

5. An integral fuel line as claimed in claim 1, wherein said innermost tube is made of a metallic material, and wherein said intermediate and outer tubes are made of non-conductive plastic materials.

6. An integral fuel line as claimed in claim 1, wherein at least one of said innermost, intermediate and outer tubes is made of a metallic material, and wherein the other remaining tubes are made of a conductive or non-conductive plastic material.

7. An integral fuel line as claimed in claim 1, wherein said innermost tube is formed of a non-conductive plastic material on its inner diameter and is surrounded with a thin layer of metallic material.

8. An integral fuel line as claimed in claim 1, wherein said innermost tube has an inner diameter of 6 mm and an outer diameter of 8 mm with a 1 mm wall thickness.

9. An integral fuel line as claimed in claim 1, wherein said outer tube has an inner diameter of 13.4 mm and an outer diameter of 15.4 mm with a 1 mm wall thickness.

10. An integral fuel line for use in a fuel injection type of fuel distribution system for motor vehicles, said fuel line comprising:

an innermost tube defining a high pressure line and having a first passage for delivering fuel from a storage tank to an engine cylinder of the motor vehicle;

an intermediate tube defining a low pressure line being disposed around said innermost tube in tangential relationship to form a second passage therebetween for returning the unused portion of the fuel back to the storage tank; and an outer tube defining a vapor recovery line being disposed around said intermediate tube in tangential relationship to form a third passage therebetween for returning vaporized and evaporated fuel back to the storage tank.

11. An integral fuel line as claimed in claim 10, further comprising terminal block means joined to the ends of said innermost, intermediate and outer tubes and having corresponding fluid passages in communication with the respective said first, second and third passages for facilitating a rapid connection to a quick-connection member.

12. An integral fuel line as claimed in claim 10, wherein said innermost, intermediate and outer tubes are made of a non-conductive plastic material, and wherein a wire is disposed within said innermost tube to ground static charge.

13. An integral fuel line as claimed in claim 10, wherein said innermost, intermediate and outer tubes are made of a conductive plastic material.

14. An integral fuel line as claimed in claim 10, wherein said innermost tube is made of a metallic material, and wherein said intermediate and outer tubes are made of non-conductive plastic materials.

15. An integral fuel line as claimed in claim 10, wherein at least one of said innermost, intermediate and outer tubes is made of a metallic material, and wherein the other remaining tubes are made of a conductive or non-conductive plastic material.

16. An integral fuel line as claimed in claim 10, wherein said innermost tube is formed of a non-conductive plastic material on its inner diameter and is surrounded with a thin layer of metallic material.

17. An integral fuel line as claimed in claim 10, wherein said innermost tube has an inner diameter of 6 mm and an outer diameter of 8 mm with a 1 mm wall thickness.

18. An integral fuel line as claimed in claim 10, wherein said outer tube has an inner diameter of 13.4 mm and an outer diameter of 15.4 mm with a 1 mm wall thickness.

19. An integral fuel line for use in a fuel injection type of fuel distribution system for motor vehicles, said fuel line comprising in combination:

an innermost tube defining a high pressure line and having a first passage for delivering fuel from a storage tank to an engine cylinder of the motor vehicle;

an intermediate tube defining a low pressure line being spaced from and surrounding said innermost tube to form a second passage therebetween for returning the unused portion of the fuel back to the storage tank;

an outer tube defining a vapor recovery line being spaced from and surrounding said intermediate tube to form a third passage therebetween for returning vaporized and evaporated fuel back to the storage tank; and terminal block means joined to the ends of said innermost, intermediate and outer tubes and having corresponding fluid passages in fluid communication with the respective said first, second and third passages for facilitating a rapid connection to a quick-connection member.

20. An integral fuel line as claimed in claim 19, wherein said innermost tube is made of a metallic material, and wherein said intermediate and outer tubes are made of non-conductive plastic materials.

* * * * *